US005411344A

United States Patent [19]

Gagne

[11] Patent Number: 5,411,344

[45] Date of Patent: May 2, 1995

[54] SAFETY MARKING PEN FOR SMALL CHILDREN

[76] Inventor: Mary L. Gagne, P.O. Box 213, North Chatham, N.Y. 12132

[21] Appl. No.: 230,514

[22] Filed: Apr. 20, 1994

[51] Int. Cl.[6] ..... B43K 9/00; B43K 8/02; B43K 23/00

[52] U.S. Cl. ..... 401/202; 401/6; 401/88; 401/48; 401/192; 401/193; D19/41; D19/43; D19/46; D19/51

[58] Field of Search ..... 401/88, 131, 192, 193, 401/202, 48, 6; D19/81, 51, 54, 55, 46, 43, 41

[56] References Cited

U.S. PATENT DOCUMENTS

| | | | |
|---|---|---|---|
| D. 18,491 | 7/1888 | Jones | D19/46 X |
| D. 29,917 | 1/1899 | Miller | D19/81 X |
| D. 321,719 | 11/1991 | Nitta | D19/48 |
| 2,143,712 | 1/1939 | Rissman | 401/192 |
| 3,459,483 | 8/1969 | Brastad | 401/131 |
| 3,797,706 | 3/1974 | Fisher et al. | 401/193 |
| 4,369,580 | 1/1983 | Pruitt | 401/193 X |

FOREIGN PATENT DOCUMENTS

| | | | |
|---|---|---|---|
| 347097 | 7/1960 | Switzerland | 401/93 |

*Primary Examiner*—Steven A. Bratlie
*Attorney, Agent, or Firm*—Henry S. Miller; Rhodes & Ascolillo; David L. Baker

[57] ABSTRACT

A marker pen having a clear plastic disk at one end and a clear plastic hemispheric shaped member at the other end, proximate the nib whereby a small child can write or draw in a normal fashion, see through the plastic the results of his endeavors but is unable to place either end of the marker into the mouth. A cover is provided for storage and the ink is a non toxic water color.

10 Claims, 2 Drawing Sheets

SAFETY MARKING PEN FOR SMALL CHILDREN

BACKGROUND OF THE INVENTION

1. Field of the invention

This invention relates generally to safety products for small children and in particular to marking pens used by children for writing and drawing.

2. Description of the prior art

Very young children have a propensity to place nearly every thing they can hold into their mouth. Before a child becomes too mobile it is relatively simple to limit what the he or she handles. As an infant grows it is important to allow the child to express itself for many and various reasons. One manner of expression is through the use of artistic abilities. Many young parents see this as more of a method for babysitting but never the less if a small or young child is given the opportunity to express it self in a visual form it will need the tools to do that.

Typically,in the past children were given paper and pencil or wax crayons and paper as expressive tools. More recently, colorful felt tipped marking pens have become available which, when accompanied by the appropriate recording medium will provide hours of pleasure for the child and relief for the parent.

In order for the parents to feel comfortable they must feel completely satisfied that the tools the child is using are completely safe and non damaging. A three year old child with a conventional marking pen could inflict damage on him/her self or others by thrusting the pen into the eye or mouth or even biting off the tip and swallowing it. Further, the ink could be applied liberally in inappropriate places causing embarrassing and expensive property damage.

A typical marker pen is seen in U.S. Pat. No. Des. 321,719 issued Nov. 19, 1991 to Nitta. The pen consists of a pen barrel with a pocket clip and a grasping area on the outside and a retractable felt tip and plunger on the inside. The pen which is not atypical and could easily cause the personal injury or property damage described above.

There is a need then for a safe, non damaging marking pen particularly adapted for use by small or young children.

SUMMARY OF THE INVENTION

The marking pen of the invention has a cylindrical, barrel shape body configuration common in most general purpose pens seen on the market today. Since the invention is designed for small children the body is shorter and smaller in diameter then pens currently available today. The body contains a nib of felt or other material which extends from the barrel but is hemispherically shaped to discourage its being bitten off by the user. Nib material extending into the barrel communicates with an ink reservoir filling the remaining void within the body. Surrounding the body adjacent the nib is a clear, hemispherical shaped member that prevents insertion of the nib end of the barrel into particularly the cranial cavities of the body. It also inhibits children from grasping the pen near the nib, thereby coloring the fingers along with the provided surface. The end of the body away from the nib is equipped with a clear plastic dual function disk. This disk prevents the insertion of the barrel into the cranial cavities of the body but it is also spaced from the hemispherical shaped member sufficiently to act as a restraint and help keep the pen from accidently slipping from the child's hand. The invention also provides a protective cover that snaps over the nib and hemispherical surface to prevent, accidental marking, the ink from drying and to deny access to small children. Ink used in the pen is a non toxic water color which can be easily removed from walls, clothing and little fingers.

It is therefore an object of the invention to provide a new and improved safety marking pen for young children.

It is another object of the invention to provide a new and improved safety marking pen for young children that will prevent insertion of the pen into various body openings in the head.

It is a further object of the invention to provide a new and improved safety marking pen for young children that will resist a child's attempt to place the nib in its mouth.

It is still another object of the invention to provide a new and improved safety marking pen for small children that is adapted to fit the small hand.

It is still a further object of the invention to provide a new and improved cover for a safety marking pen.

It is another object of the invention to provide a new and improved safety marking pen for small children that may be easily and efficiently manufactured and marketed.

It is another object of the invention to provide a new and improved safety marking pen for small children which is of durable and reliable construction.

These and other advantages, features and objects of the invention will become more apparent from the following description taken in connection with the illustrative embodiment in the accompanying drawings.

DESCRIPTION OF THE PREFERRED EMBODIMENT

Figure 1:
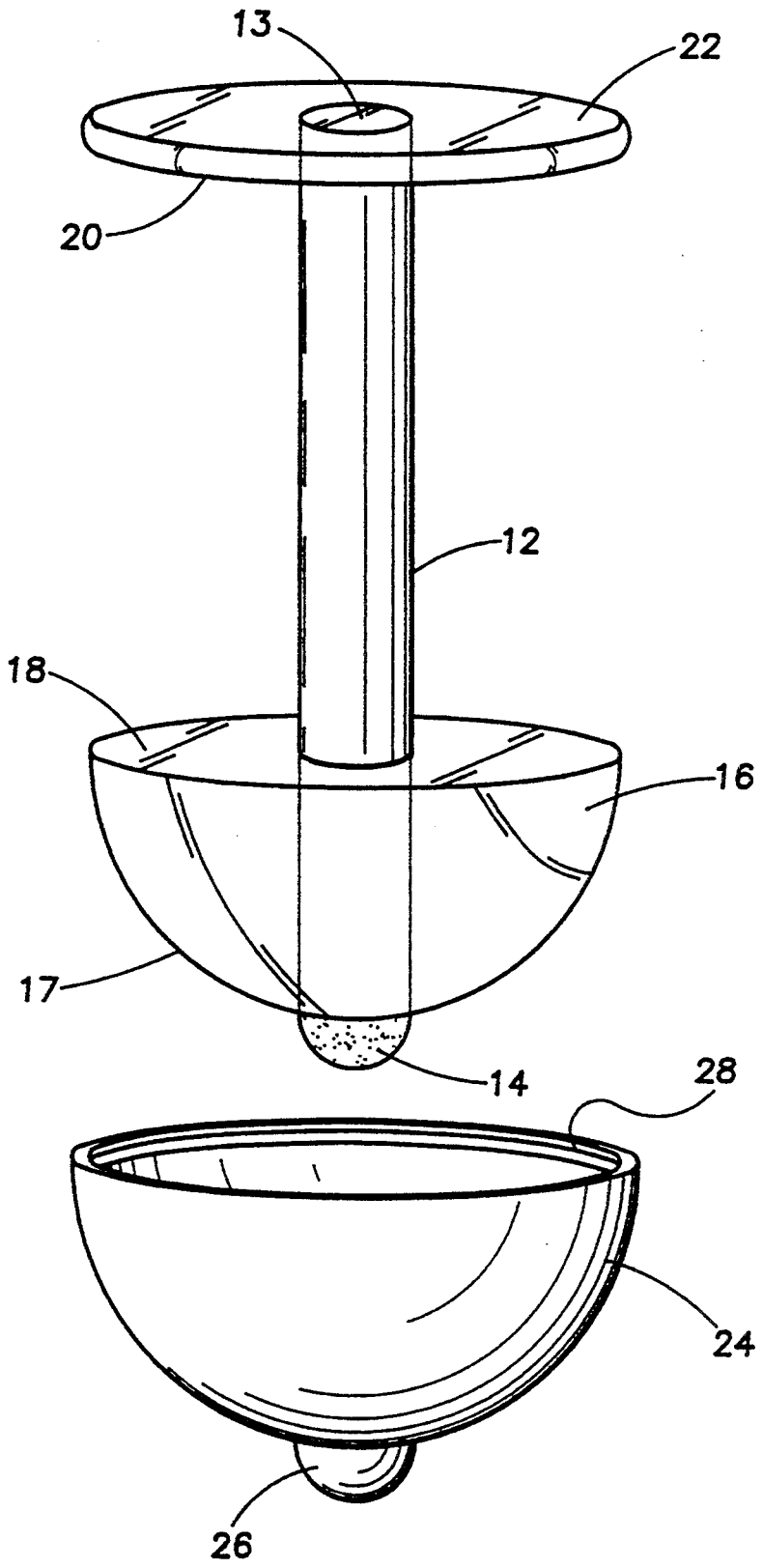
FIG. 1 is a perspective view of the invention.

Referring now to FIG. 1, the safety marking pen is shown generally at 10, the barrel 12 has a closed end 13 and an open end containing a hemispherical shaped nib 14. A clear plastic safety member 16 is permanently affixed to the barrel 12 in a close proximity to the nib 14. The member 16 has one face forming a hemispherical surface 17, thereby allowing the nib to contact a surface at various acute angles without interference from the member. Another surface 18 of member 16 is planar and parallel with surface 20 of the clear plastic safety disk 22. In use the child would grasp the barrel and make his/her mark with nib 14. Since the plastic, such as lexon for example, is clear the child could see his work but not be able to put the nib or the butt end (13) into its own eye or someone else's.

When not in use, a cover 24 formed of flexible plastic, encloses the hemisphere 16 including the nib by the adoptive fit of the cover at 26. A ridge 28 is provided around the interior perimeter of the cover engages the surface 18 holding the cover securely in place. To remove the cover one only has to engage the lip with a thumb or other finger and gently pry the cover free.

Figure 2:
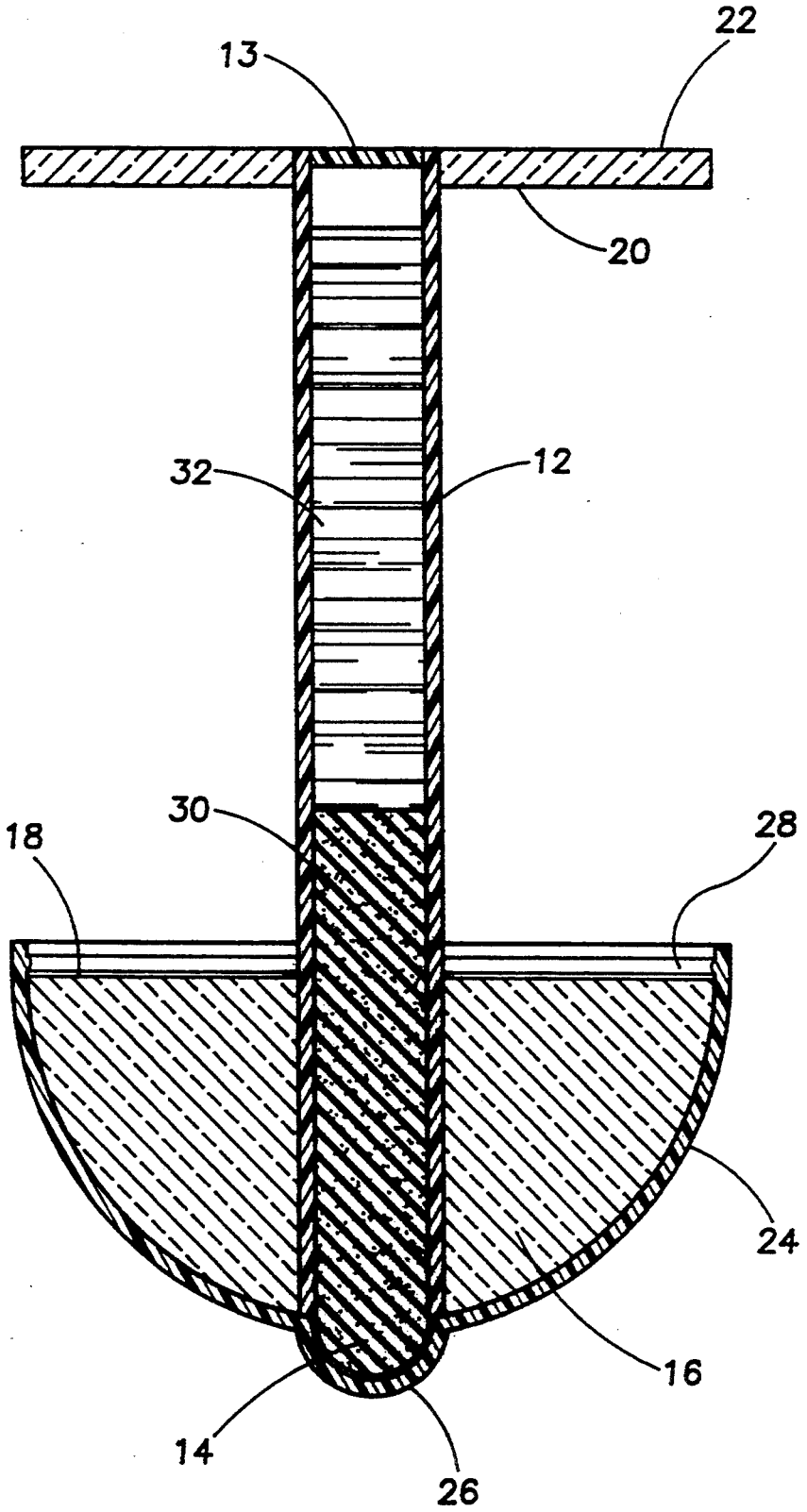
FIG. 2 is a cross sectional view of the invention.

Concerning FIG. 2, the barrel 12 is shown having the nib material 30 extending into the ink reservoir 32. Lip 28 is shown as it engages surface 28 of member 16. The ink used in the pen would be a non toxic water color of a type currently available on the retail market.

All material parts of the marking pen are constructed of sufficient size to inhibit a child from putting the pen into its mouth.

It should be understood, of course, that the foregoing disclosure relates to only a preferred embodiment of the invention and that numerous modification of alterations may be made therein without departing from the spirit and scope of the invention as set forth in the appended claims.

What is claimed is:

1. A safety marking pen for young children comprising:

a cylindrical hollow body containing an ink reservoir at an end of the cylindrical hollow body and marking nib communicating with the reservoir at another end of the cylindrical hollow body;

a first protective disk shaped member secured to the end of said hollow body, a second protective semi-hemispheric member having a passageway therethrough to securely accept the cylindrical hollow body, said second protective semi-hemispheric member being secured to the cylindrical hollow body at a point distal the first protective disk shaped member;

a third protective means comprising a hollow semi-hemispheric cover, releasably secured to said second protective semi-hemispheric member, distal from said first protective disk shaped member proximate the marking nib; and a semi-hemispheric protective adaptor attached to the semi-hemispheric cover to releasably engage the marking nib.

2. A safety marking pen for young children according to claim 1 wherein the first protective disk shaped member is plastic.

3. A safety marking pen for young children according to claim 2 wherein the first protective disk shaped member is clear plastic.

4. A safety marking pen for young children according to claim 3 wherein the disk shaped member is clear lexon plastic.

5. A safety marking pen for young children according to claim 1 wherein a planar face of the second protective semi- hemispheric member is medial and parallel to the first protective disk shaped member.

6. A safety marking pen for young children according to claim 5 wherein the second protective semi- hemispheric member is clear plastic.

7. A safety marking pen for young children according to claim 6 wherein the second protective semi- hemispheric member is clear lexon plastic.

8. A safety marking pen for young children according to claim 1 wherein the nib is substantially semi-hemispherical in shape.

9. A safety marking pen for young children according to claim 1 wherein: the ink is a non toxic water color.

10. A safety marking pen for young children according to claim 1 wherein the hollow semi-hemispheric cover is formed of flexible plastic and said cover has a retaining lip to engage and releasably secure to said second protective semi-hemispheric member.

* * * * *